United States Patent [19]

Zovar

[11] Patent Number: 4,645,163

[45] Date of Patent: Feb. 24, 1987

[54] CLIP BOARD DESK AND STAND

[76] Inventor: Alan P. Zovar, 18333 Hatteras St., #28, Tarzana, Calif. 91356

[21] Appl. No.: 737,714

[22] Filed: May 28, 1985

[51] Int. Cl.[4] ..... A47B 97/04

[52] U.S. Cl. ..... 248/452; 248/456; 24/67.7; 108/1; 108/13; D19/88; 281/45

[58] Field of Search ..... 248/451–457, 248/460, 462–465; 24/67.7; 108/13, 1, 43; 281/45, 42, DIG. 1, 15 B; D19/88; 40/341, 11 A

[56] References Cited

U.S. PATENT DOCUMENTS

| | | | |
|---|---|---|---|
| 314,769 | 3/1885 | Yeiser | 24/67.7 |
| 504,951 | 9/1893 | Streeter | 248/455 |
| 590,273 | 9/1897 | McPhee | 24/67.7 |
| 777,658 | 12/1904 | Bird | 248/460 |
| 1,019,348 | 3/1912 | Northam | 24/67.7 |
| 1,218,276 | 3/1917 | Klein | 24/67.7 |
| 1,888,773 | 11/1932 | Ruelland | 248/452 |
| 2,273,584 | 2/1942 | Moore | 248/452 |
| 2,648,931 | 8/1953 | Deveau | 248/460 |
| 3,272,183 | 9/1966 | Craighead | 248/453 |
| 3,821,936 | 7/1974 | Morse | 108/43 |
| 4,044,980 | 8/1977 | Cummins | 248/460 |
| 4,378,102 | 3/1983 | Portis | 248/451 |

FOREIGN PATENT DOCUMENTS

| | | | |
|---|---|---|---|
| 217899 | 10/1961 | Austria | 281/45 |
| 5957 | 12/1979 | European Pat. Off. | 248/460 |
| 2381491 | 10/1978 | France | 108/43 |
| 80591 | 8/1952 | Norway | 248/456 |
| 152557 | 2/1932 | Switzerland | 248/456 |

*Primary Examiner*—J. Franklin Foss
*Assistant Examiner*—Robert A. Olson
*Attorney, Agent, or Firm*—Lewis Anten

[57] ABSTRACT

A clip board with a clip which is convertable into a stand or rest for supporting the board at an inclined angle when laid on a table as a portable desk. A separate stand is provided for supporting the clip board for use as a copy board.

5 Claims, 8 Drawing Figures

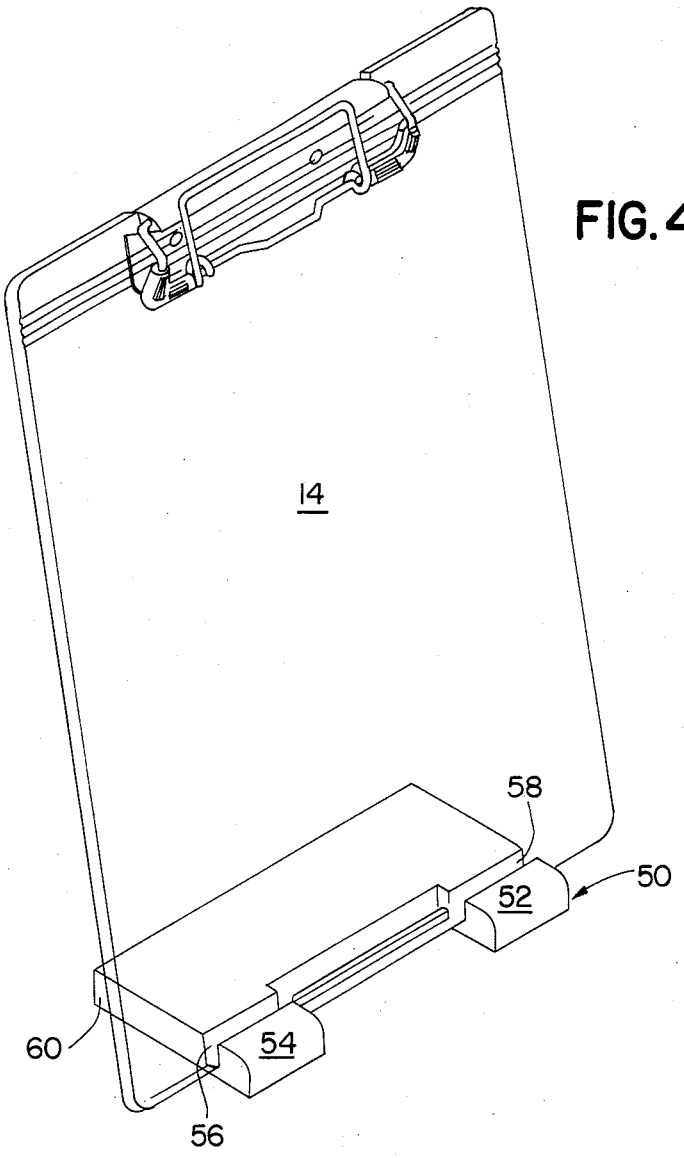
FIG. 4
FIG. 5
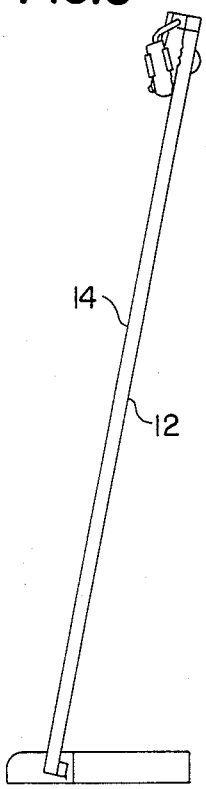
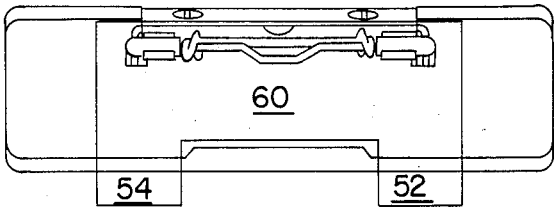
FIG. 6

CLIP BOARD DESK AND STAND

BACKGROUND OF THE INVENTION

This invention relates to clip boards and more particularly to a clip board in which the clip mechanism in convertable into a stand to enable it to be turned over and used as a portable desk. The invention also relates to a stand for use with the clip board which mounts the same in an upright position for use as copy board.

Heretofore, clip boards have had limited utility, not being adapted to be used as portable desks or readily used on a table. Commonly the contents of the clip board would be removed and the clip board set aside when used on a table is a available. a table. There is, therefore, a need for a new and improved clip board which will overcome the above limitations.

SUMMARY OF THE INVENTION AND OBJECTS

In general it is an object of the present invention to provide an improved clip board in which the clip can be adjusted to convert the board for dual use so that in one position the board serves as a regular clip board while in the other position the clip mechanism is locked up to elevate one end of the board in a stable position so that when the board is turned over it lies at an inclined angle for use as portable desk.

A further object is to provide a stand for converting the clip board to use as a copy board.

The clip board is provided with smooth usable writing surfaces both on its front and back sides. The front onto the clip is provided with a indentation for receiving a support bar which is attached by a pair of arms to the clip itself. Thus, with the clip pulled fully open, the support bar can be lodged in the indent which then cooperates with the clip to serve as a triangular support rest for one end of the board. The clip board can then be laid on the desk and will be upwardly inclined at a convenient angle for reading and writing at an angle relieving neck strain. A paper stop is preferably incorporated at the lower edge of the rear surface so that papers and books will not slide off the board when used as a desk.

A separate stand is also provided for enabling the clip board to be posted in an upright position for use as a copy board.

These and other objects and features of the invention will become apparent from the following description and claims when together with the accompanying drawings of which:

BRIEF DESCRIPTION OF THE DRAWINGS

FIG. 4 is a perspective view of the clip board desk of the present invention showing the same mounted as a stand for use as a copy board.

FIG. 5 is a side elevational view of the clip board and stand of FIG. 4.

FIG. 6 is a top plan view of FIG. 4.

FIG. 8 is a perspective view of the clip board desk of the present invention removed from the stand and fitted with a strap for carrying papers, notebooks, books and the like.

DETAILED DESCRIPTION OF THE PREFERRED EMBODIMENT

Figure 1:
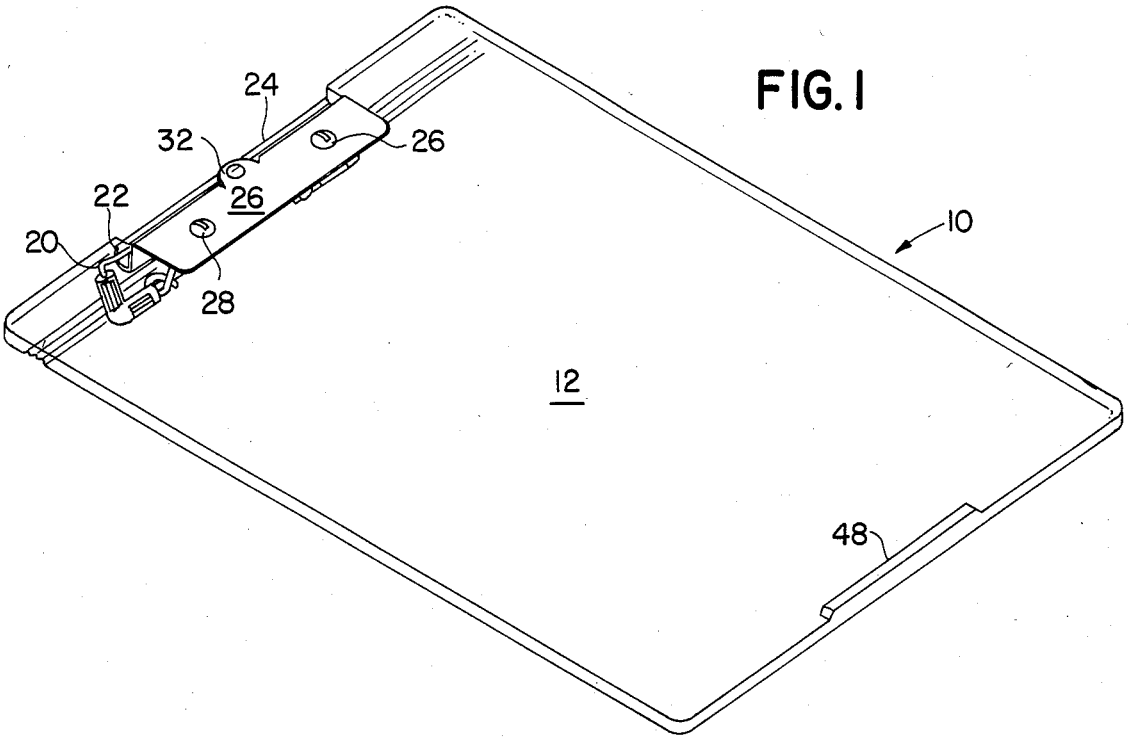
FIG. 1 is a perspective view of the clip board desk of the present invention set up to form a portable desk.
Figure 2:
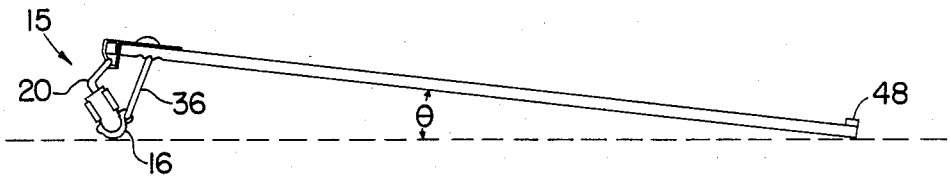
FIG. 2 is a side view of the clip board desk of FIG. 1 showing the board resting on a surface such as a table.
Figure 3:
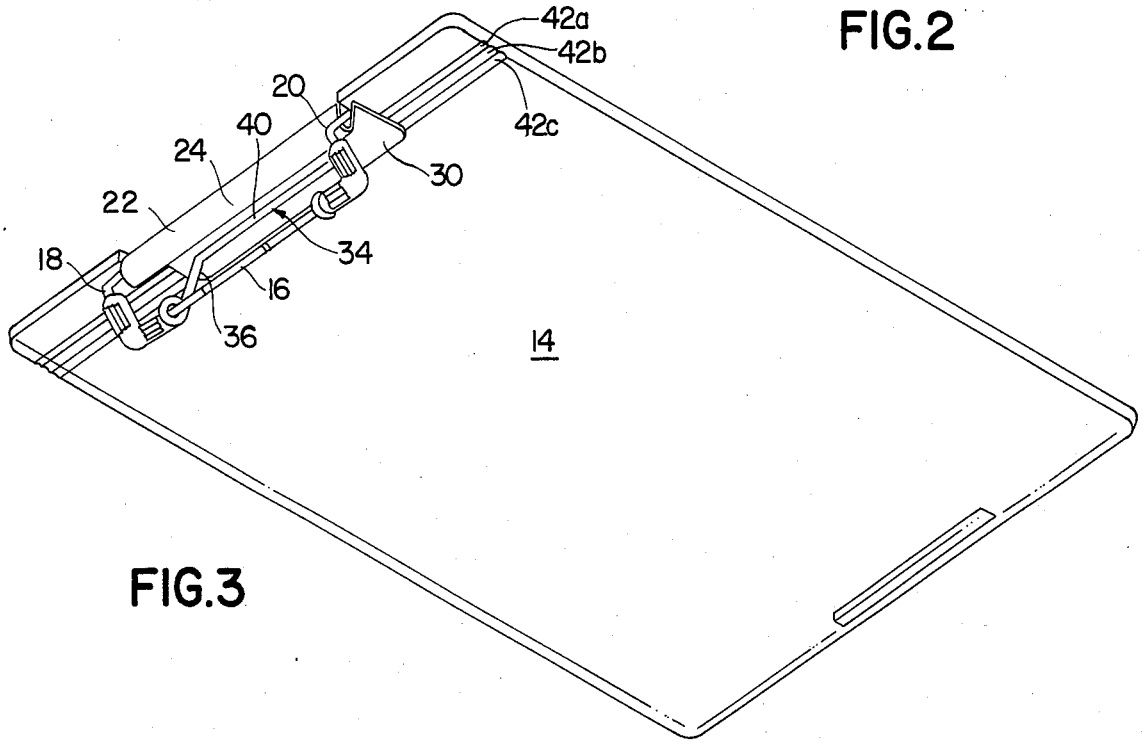
FIG. 3 is a bottom perspective view of the clip board desk of FIG. 1.
Figure 7:
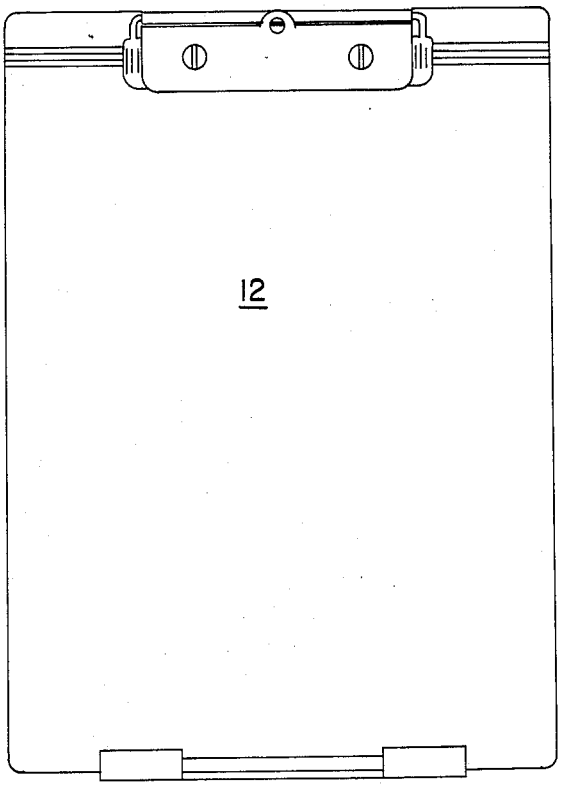
FIG. 7 is a front elevational view of FIG. 4.

Referring now to FIGS. 1 through 3 the clip board desk of the present invention consists of a board portion having two smooth, flat sides 12,14 each of which is usable for a writing surface, one side 14 being used when being employed as a clip board while reverse side 12 is used as a book support or writing surface when employed as a portable desk in the manner shown in FIGS. 1 through 3. A clip mechanism 15 is provided at one end of the clip board and includes an outer bar 16 connected by arms 18,20 to an inner pin 22 mounted for rotation in bracket 24 having a tongue or flap 26 fastened through one end of the board and secured therethrough with screws 26,28 to another flap 30 on the other side. The bracket has a U-shaped loop circling the pin and is provided with a spring-loaded mechanism (not shown) which engages the pin to urge the bar towards surface 14 of the board and securely hold the interposed papers, note pads or books in a known manner. An ear 32 is formed to extend outwardly as part of flap 36 for forming a hanging loop as is known.

Means is provided for securely latching the clip in an open position to convert it to a stand extending substantially at right angles away from the board. In the present embodiment such means preferably includes a metal loop 34 having arms 36,38 at each end extending at right angles to a second bar 40, the arms encircling the first bar so that the loop 34 can be freely rotated about the first bar and brought from a rest position magnetically held to the pin bracket 24. The latter incorporates a magnet for capturing the second bar 40 which is made of magnetically attractible iron. In the other position the bar may be rotated into alignment so as to lie in one of grooves 42*a,b,c* formed in the surface 14 and extending across the width of the board at that end. The grooves are immediately underneath the spring clip bar 16. In this way the second bar engages the groove and serve to hold the clip bar 16 in an open, fully extended position, best shown in FIG. 2. When the clip is extended the board is ready to be laid on a table top where it serves as an inclined portable desk. An upstanding paper or bookrest 48 is provided at the bottom at the end away from the clip mechanism to keep papers and books from sliding down or off the board during use. Preferably the clip is constructed to open far enough to obtain about a 15° angle of board inclination when it is fully extended. At about 15° the angle is sufficient to obtain good relief from neck strain commonly associated with reading and writing at flat desks or tables.

FIG. 4 shows the clip board 10 of the invention mounted in a stand 50 for use as a copy holder. The stand is made of a solid block of material having a pair of projections 52,54 extending from the front along which slots 56,58 are formed to receive the bottom edge of the board and to support the same with a rearward inclination of about 15°. The projections 52,54 are spaced apart far enough to allow the paper rest 48 on the rear side of the board to fall between them. The stand extends rearwardly at 60 far enough to support the board upright without any tendency of the same to fall backwards.

Figure 8:
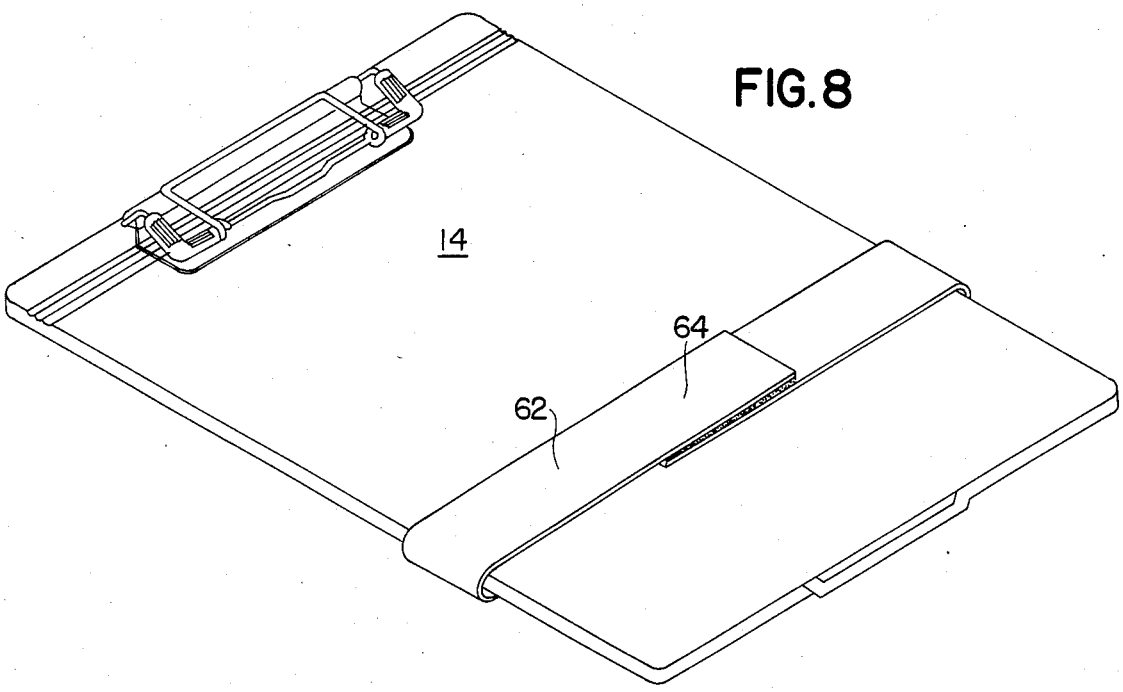

FIG. 8 shows the clip board of the invention in conventional use with a Velcro (trademark) elastic strap 62 secured thereabout with an overlapped Velcro (trademark) fastener 64 for retaining a book or note pad against falling off.

What is claimed is:

1. A clip board constructed for being reversed for use as a portable desk comprising a board having front and back smooth usable writing surfaces on the front and rear sides thereof, clip means mounted to one end of the board and including a first spring loaded bar for clamping interposed materials to the board on the front side thereof, means for affixing the spring loaded bar in a stable position when open including a support bar terminated at its ends by a pair of arms extending away therefrom and rotatably attached to said spring loaded bar, means forming at least one groove extending underneath said spring loaded bar so that, when the support bar is rotated about the spring loaded bar and positioned in the groove means, it is captured therein by the return force of the spring loaded bar and supports the spring loaded bar in an open, extended and stable position to form therewith a rigid structure extending away from the board or said front side so that the clip board can be laid on a table on its front side supported by the extended bars in an inclined position for use as a portable desk.

2. The clip board as in claim 1 further including a rest stop extending along the lower reverse side of the board for supporting books and papers from sliding off when the board is used as a portable desk.

3. The clip board as in claim 2 further including a stand to enable the clip board to be used as a copy holder comprising a block of material having a slot therein for receiving the bottom edge of a clip board, said slot being inclined slightly to the vertical in one direction so that the clip board leans rearwardly, said block of material having a rearwardly extending portion for supporting the clip board from falling backward and means forming a recess in the block at lower central forward portion to allow the rest stop to pass as the board fits in said slot.

4. The clip board as in claim 1 further including magnetic means associated with the clip mechanism for holding the second bar in closed position when not in use.

5. The clip board as in claim 1 further including a stand to enable the clip board to be used as a copy holder comprising a block of material having a slot therein for receiving the bottom edge of the clip board, said slot being inclined slightly to the vertical in one direction so that the clip board leans rearwardly, said block of material having a rearwardly extending portion for supporting the clip board from falling backward.

* * * * *